US010233851B2

(12) United States Patent
Fukui et al.

(10) Patent No.: US 10,233,851 B2
(45) Date of Patent: Mar. 19, 2019

(54) EVAPORATED FUEL PROCESSING APPARATUS

(71) Applicants: TOYOTA JIDOSHA KABUSHIKI KAISHA, Toyota-shi, Aichi-ken (JP); AISAN KOGYO KABUSHIKI KAISHA, Obu-shi, Aichi-ken (JP)

(72) Inventors: Keita Fukui, Fujinomiya (JP); Makoto Yamazaki, Gotemba (JP); Yoshikazu Miyabe, Obu (JP)

(73) Assignees: TOYOTA JIDOSHA KABUSHIKI KAISHA, Toyota-shi (JP); AISAN KOGYO KABUSHIKI KAISHA, Obu-shi (JP)

( * ) Notice: Subject to any disclaimer, the term of this patent is extended or adjusted under 35 U.S.C. 154(b) by 0 days.

(21) Appl. No.: 15/847,062

(22) Filed: Dec. 19, 2017

(65) Prior Publication Data

US 2018/0171894 A1 Jun. 21, 2018

(30) Foreign Application Priority Data

Dec. 21, 2016 (JP) ..... 2016-248107

(51) Int. Cl.
*F02D 41/00* (2006.01)
*F02D 41/24* (2006.01)
*F02M 25/08* (2006.01)

(52) U.S. Cl.
CPC ..... *F02D 41/003* (2013.01); *F02D 41/2438* (2013.01); *F02M 25/0836* (2013.01);
(Continued)

(58) Field of Classification Search
CPC ..... F02M 25/08; F02M 25/0836; F02M 25/0854; F02M 25/0872; F02M 25/089;
(Continued)

(56) References Cited

U.S. PATENT DOCUMENTS 6,988,396 B2 * 1/2006 Matsubara ..... F02M 25/0818 73/114.38
2009/0099795 A1 * 4/2009 Behar ..... F02M 25/0818 702/51

(Continued)

FOREIGN PATENT DOCUMENTS

JP 2015-110913 A 6/2015
JP WO 2016035654 A1 * 3/2016 ..... F02M 25/08

(Continued)

*Primary Examiner* — John Zaleskas

(57) ABSTRACT

An evaporated fuel processing apparatus is provided with a blocking valve disposed in a vapor passage. The blocking valve has: a valve whose stroke amount is adjusted by a stepping motor; and a relief valve being opened regardless of the stroke amount when tank pressure of a fuel tank is greater than or equal to a predetermined pressure to allow communication between the fuel tank and a canister. The evaporated fuel processing apparatus is provided with a controller configured (i) to control the stepping motor to move the valve in a valve opening direction while prohibiting a valve opening position learning process when the tank pressure is greater than or equal to the predetermined pressure and (ii) to allow the valve opening position learning process when the tank pressure is less than the predetermined pressure.

1 Claim, 4 Drawing Sheets

(52) U.S. Cl.
CPC ..... *F02D 2200/0602* (2013.01); *F02D 2200/703* (2013.01); *F02M 25/0854* (2013.01); *F02M 25/0872* (2013.01)

(58) Field of Classification Search
CPC ..... F02D 41/003; F02D 41/2438; B60K 15/03519
USPC ..... 123/519, 520
See application file for complete search history.

(56) References Cited

U.S. PATENT DOCUMENTS

2011/0220071 A1* 9/2011 Horiba ..... F02M 25/0836 123/520
2011/0253110 A1* 10/2011 Fukui ..... F02D 41/004 123/520
2012/0211687 A1* 8/2012 Benjey ..... B60K 15/03519 251/248
2014/0102420 A1* 4/2014 Kimoto ..... F02M 25/0836 123/520
2015/0143996 A1* 5/2015 Kimoto ..... B01D 53/0454 96/114
2015/0159566 A1* 6/2015 Akita ..... F02D 41/003 137/488
2015/0159567 A1* 6/2015 Akita ..... F02D 41/003 137/624.27
2015/0159568 A1* 6/2015 Tagawa ..... F02D 41/003 137/624.27
2015/0159598 A1* 6/2015 Tagawa ..... F02M 25/0854 123/520
2015/0292447 A1* 10/2015 Tagawa ..... F02M 25/0809 137/198
2015/0330338 A1* 11/2015 Ito ..... F02M 25/0836 123/520
2016/0186697 A1* 6/2016 Tsuzuki ..... F02M 25/0836 123/519
2016/0186700 A1* 6/2016 Nishiura ..... F02M 25/0854 123/519
2016/0356227 A1* 12/2016 Akita ..... F02M 25/0836
2017/0145932 A1* 5/2017 Tagawa ..... F02D 41/2464
2017/0282706 A1* 10/2017 Miyabe ..... F02M 25/08
2017/0356394 A1* 12/2017 Murai ..... F02D 41/0045
2018/0171895 A1* 6/2018 Fukui ..... F02D 41/003
2018/0264937 A1* 9/2018 Fukui ..... B60K 15/03504

FOREIGN PATENT DOCUMENTS

JP WO 2016035656 A1 * 3/2016 ..... B60K 15/04
JP WO 2016035657 A1 * 3/2016 ..... F02D 45/00
WO 2015/076027 A1 5/2015

* cited by examiner

EVAPORATED FUEL PROCESSING APPARATUS

CROSS-REFERENCE TO RELATED APPLICATIONS

This application is based upon and claims the benefit of priority of the prior Japanese Patent Application No. 2016-248107, filed on Dec. 21, 2016, the entire contents of which are incorporated herein by reference.

BACKGROUND OF THE INVENTION

1. Field of the Invention

Embodiments of the present invention relate to an evaporated fuel processing apparatus configured to process evaporated fuel generated in a fuel tank.

2. Description of the Related Art

For this type of apparatus, for example, there is proposed an apparatus provided with: a canister containing adsorbent for adsorbing evaporated fuel generated in a fuel tank; and a blocking valve with a stepping motor disposed in a vapor passage, which connects the canister and the fuel tank (refer to International Publication No. WO2015/076027). WO2015/076027 discloses the following matter. When a valve opening start position of a blocking valve is learned, the following processes are repeated, i.e. rotating a stepping motor A steps in a valve opening direction, rotating it B steps in a valve closing direction, and detecting tank inner pressure. If the tank inner pressure currently detected is less than a previous detected value by a predetermined value or more, it is determined that the valve opening of the blocking valve is started.

Japanese Patent Application Laid Open No. 2015-110913 discloses the following matter. In order to prevent erroneous leaning of the valve opening start position of the blocking valve, if inner pressure of the fuel tank is beyond a measurement range of a pressure sensor configured to detect the inner pressure, pressure relief control before learning is performed by gradually changing a stroke amount of the blocking valve in the valve opening direction until the inner pressure of the fuel tank falls in the measurement range of the pressure sensor.

The blocking valve used in this type of apparatus is provided in some cases with a relief valve communicating the fuel tank with the canister, due to a pressure difference between pressure on the fuel tank side of the blocking valve and pressure on the canister side of the blocking valve, independently of the stroke amount. Opening/closing of the relief valve cannot be intentionally controlled. Therefore, when the valve opening start position of the blocking valve is learned, if the pressure of the fuel tank varies because the relief valve is opened thereby to communicate the fuel tank with the canister, the valve opening start position is possibly erroneously learned. The aforementioned related art cannot solve this problem.

SUMMARY

In view of the aforementioned problem, it is therefore an object of embodiments of the present invention to provide an evaporated fuel processing apparatus configured to prevent erroneous learning of a valve opening start position of a blocking valve even when the blocking valve is provided with a relief valve.

The above object of embodiments of the present invention can be achieved by an evaporated fuel processing apparatus including: a canister containing adsorbent for adsorbing evaporated fuel generated in a fuel tank; a vapor passage connecting the canister and the fuel tank; and a blocking valve disposed in the vapor passage, wherein the blocking valve has: a first flow passage connecting a side of the fuel tank of the blocking valve and a side of the canister of the blocking valve; a second flow passage connecting the side of the fuel tank of the blocking valve and the side of the canister of the blocking valve but differing from the first flow passage; a valve disposed in the first flow passage, allowing shutoff in the first flow passage if a stroke amount is less than a predetermined amount, and allowing communication in the first flow passage if the stroke amount is greater than or equal to the predetermined amount; a stepping motor configured to adjust the stroke amount; and a relief valve disposed in the second flow passage and being opened regardless of the stroke amount when tank pressure of the fuel tank is greater than or equal to a predetermined pressure to allow communication in the second flow passage, and said evaporated fuel processing apparatus comprises a controller configured (i) to control the stepping motor to allow the communication in the first flow passage by moving the valve in a valve opening direction while prohibiting a valve opening position learning process in which a valve opening position of the valve is learned on the basis of a change in the tank pressure when the tank pressure is greater than or equal to the predetermined pressure and (ii) to allow the valve opening position learning process when the tank pressure is less than the predetermined pressure.

On the evaporated fuel processing apparatus, when the tank pressure of the fuel tank is greater than or equal to the predetermined pressure at which the relief valve is opened, the stepping motor is controlled to open the valve and the learning of the valve opening position (corresponding to the aforementioned "valve opening start position") is prohibited by the controller. In other words, on the evaporated fuel processing apparatus, if there is a possibility that the tank pressure of the fuel tank varies because the relief valve is opened, the learning of the valve opening position is prohibited and the tank pressure of the fuel tank is depressurized by opening the valve. On the other hand, when the tank pressure of the fuel tank is less than the predetermined pressure, the relief valve is not opened. The learning of the valve opening position is thus allowed.

On the evaporated fuel processing apparatus, the valve opening position is learned except a pressure range of the tank pressure in which the relief valve is opened, and it is thus possible to prevent erroneous learning of the valve opening position.

In one aspect of the evaporated fuel processing apparatus according to embodiments of the present invention, wherein said controller is configured to control the stepping motor to allow the communication in the first flow passage by moving the valve in the valve opening direction while prohibiting the valve opening position learning process when the tank pressure is greater than or equal to the predetermined pressure, and then to control the stepping motor to allow the shutoff in the first flow passage by moving the valve in a valve closing direction on condition that the tank pressure is reduced by a predetermined change amount.

When the tank pressure of the fuel tank is greater than or equal to the predetermined pressure, if the valve is kept open until the tank pressure becomes less than the predetermined pressure, there is a possibility that a relatively large amount of evaporated fuel flows in the canister. On the evaporated fuel processing apparatus, however, the valve is closed when the tank pressure of the fuel tank is reduced by the predetermined change amount after the valve is opened. It is thus possible to prevent that excessive evaporated fuel flows in the canister due to depressurization of the fuel tank.

The "predetermined change amount" is set, for example, as a change amount of the tank pressure corresponding to a maximum evaporated fuel amount that can be flown in the canister per one-time valve opening, or as a value that is less than the change amount by a predetermined value.

The nature, utility, and further features of this invention will be more clearly apparent from the following detailed description with reference to preferred embodiments of the invention when read in conjunction with the accompanying drawings briefly described below.

DETAILED DESCRIPTION OF THE PREFERRED EMBODIMENTS

An evaporated fuel processing apparatus according to an embodiment of the present invention will be explained with reference to FIG. 1 to FIG. 4.

(Entire Configuration)

Figure 1:
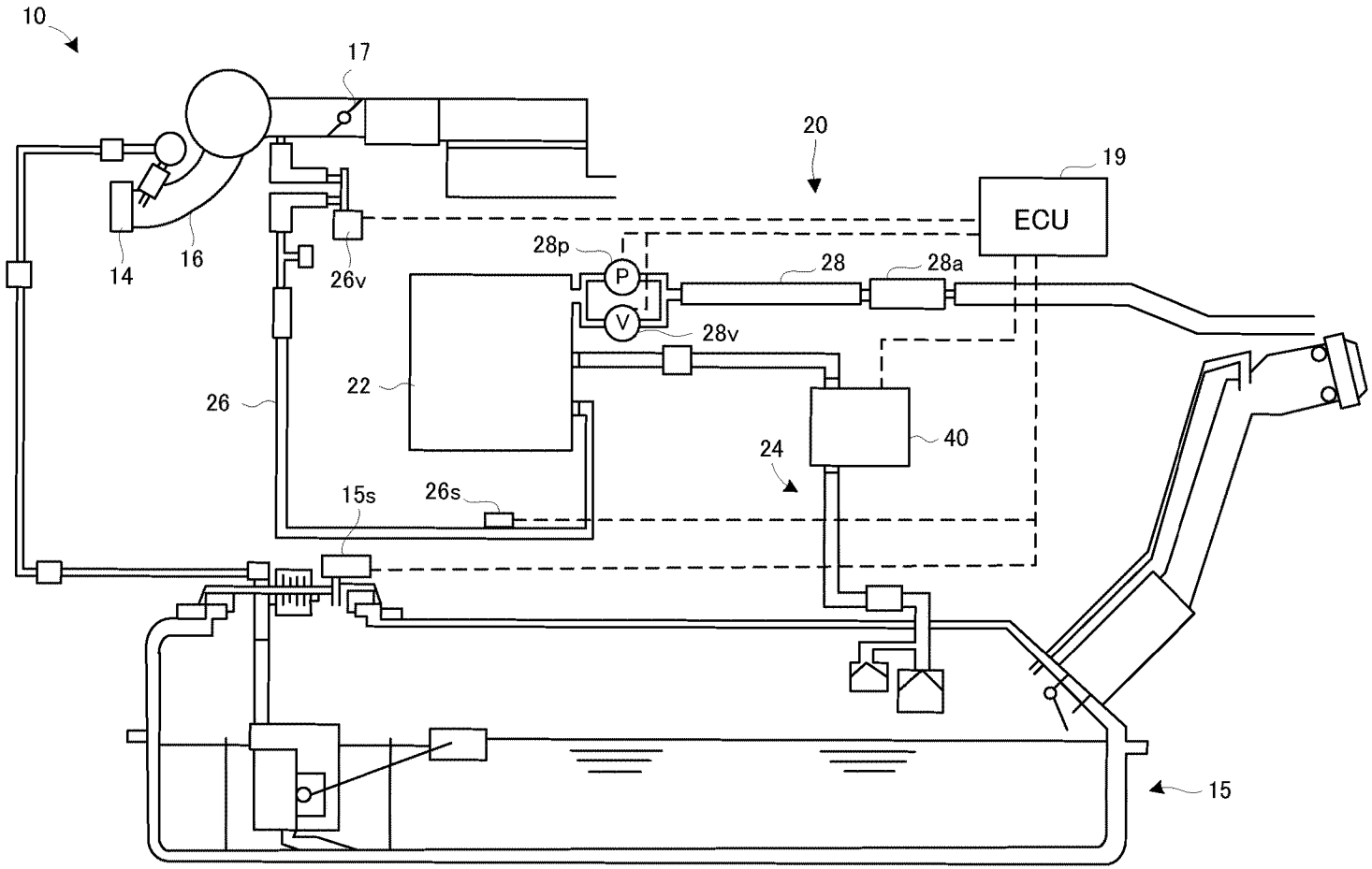
FIG. 1 is an entire configuration diagram illustrating an evaporated fuel processing apparatus according to an embodiment.

A configuration of the evaporated fuel processing apparatus according to the embodiment of the present invention will be explained with reference to FIG. 1. FIG. 1 is an entire configuration diagram illustrating the evaporated fuel processing apparatus according to the embodiment.

In FIG. 1, an evaporated fuel processing apparatus 20 is provided in an engine system 10 of a not-illustrated vehicle, and is configured to prevent that evaporated fuel generated in a fuel tank 15 of the vehicle leaks out.

The evaporated fuel processing apparatus 20 is provided with a canister 22, a vapor passage 24, a purge passage 26, and an atmospheric air passage 28. The canister 22 is filled with activated carbon as adsorbent. The canister 22 is configured to adsorb the evaporated fuel in the fuel tank 15 by using the adsorbent. The vapor passage 24 is communicated, at one end, with a gas layer part in the fuel tank 15, and is communicated, at the other end, with the canister 22. The vapor passage 24 is provided with a blocking valve 40 configured to switch between communication and shutoff in the vapor passage 24. The purge passage 26 is communicated, at one end, with the canister 22, and is communicated, at the other end, with a downstream side of a throttle valve 17 in an intake passage 16 of an engine 14. The purge passage 26 is provided with a purge valve **26*v* configured to switch between communication and shutoff in the purge passage 26**.

The canister 22 is communicated with the atmospheric air passage 28 with a tip opened to the atmosphere. The atmospheric air passage 28 is provided with an air filter **28*a*. The atmospheric air passage 28 is also provided with a switching valve 28*v* configured to switch between communication and shutoff in the atmospheric air passage 28, wherein the switching valve 28*v* is disposed nearer to the canister 22 than the air filter 28*a*. The switching valve 28*v* includes, for example, a normally open solenoid valve, which is open when the solenoid is not energized. The atmospheric air passage 28 is also provided with a pump 28*p* configured to forcibly feed an atmospheric air to the canister 22, wherein the pump 28*p* is parallel to the blocking valve 28*b*. The pump 28*p* may be of any type as long as it can pressurize an inside of a system including the canister 22 and the fuel tank 15**, but is preferably configured not to generate a gas flow in an OFF state.

The blocking valve 40, the purge valve **26*v*, the switching valve 28*v*, and the pump 28*p* are controlled on the basis of signals from an electronic control unit (ECU) 19. In other words, in the embodiment, a part of functions of the ECU 19 for various electronic controls of the vehicle is used as a part of the evaporated fuel processing apparatus 20**.

The evaporated fuel processing apparatus 20 is provided with: a tank pressure sensor **15*s* disposed in the fuel tank 15; and an evaporation system pressure sensor (hereinafter referred to as a "system pressure sensor") 26*s* disposed nearer to the canister 22 than the purge valve 26 in the purge passage 26, as pressure sensors configured to detect pressure in the system. The tank pressure sensor 15*s* is configured to detect tank pressure of the fuel tank 15 (more precisely, pressure of an area on the side of the fuel tank 15 out of two areas into which the system is separated by the blocking valve 40). The system pressure sensor 26*s* is configured to detect pressure of an area including the canister 22 (or specifically, an area into which the system is partitioned by the purge valve 26*v*, the switching valve 26*v*, and the blocking valve 40) (hereinafter referred to as "system pressure") out of two areas into which the system is separated by the blocking valve 40. The ECU 19 is configured to receive signals from the tank pressure sensor 15*s* and the system pressure sensor 26*s***.

(Overview of Operation of Evaporated Fuel Processing Apparatus)

Next, an overview of operation of the evaporated fuel processing apparatus 20 configured in the above manner will be explained. By the control of the ECU 19, the purge valve **26*v* is appropriately opened if a predetermined purge condition is satisfied during running of the vehicle. At this time, the switching valve 28*v* is open, and the atmospheric air thus flows in from the atmospheric air passage 28 due to intake negative pressure of the engine 14. The evaporated fuel purged from the adsorbent of the canister 22 by the atmospheric air is introduced into an intake passage 17 of the engine 14 via the purge valve 26*v*. The ECU 19 is also configured to open the blocking valve 40 (or specifically, detach a seal member 76 of a valve body 70, described later, from a valve seat of a valve casing 42) and to perform pressure relief control of the fuel tank 15 if the tank pressure detected by the tank pressure sensor 15*s* is greater than a first predetermined pressure. Various existing aspects can be applied to the control associated with the purge of the evaporated fuel adsorbed on the adsorbent of the canister 22, and the pressure relief control of the fuel tank 15**. An explanation of the details of the controls will be thus omitted.

(Configuration of Blocking Valve)

Figure 2:
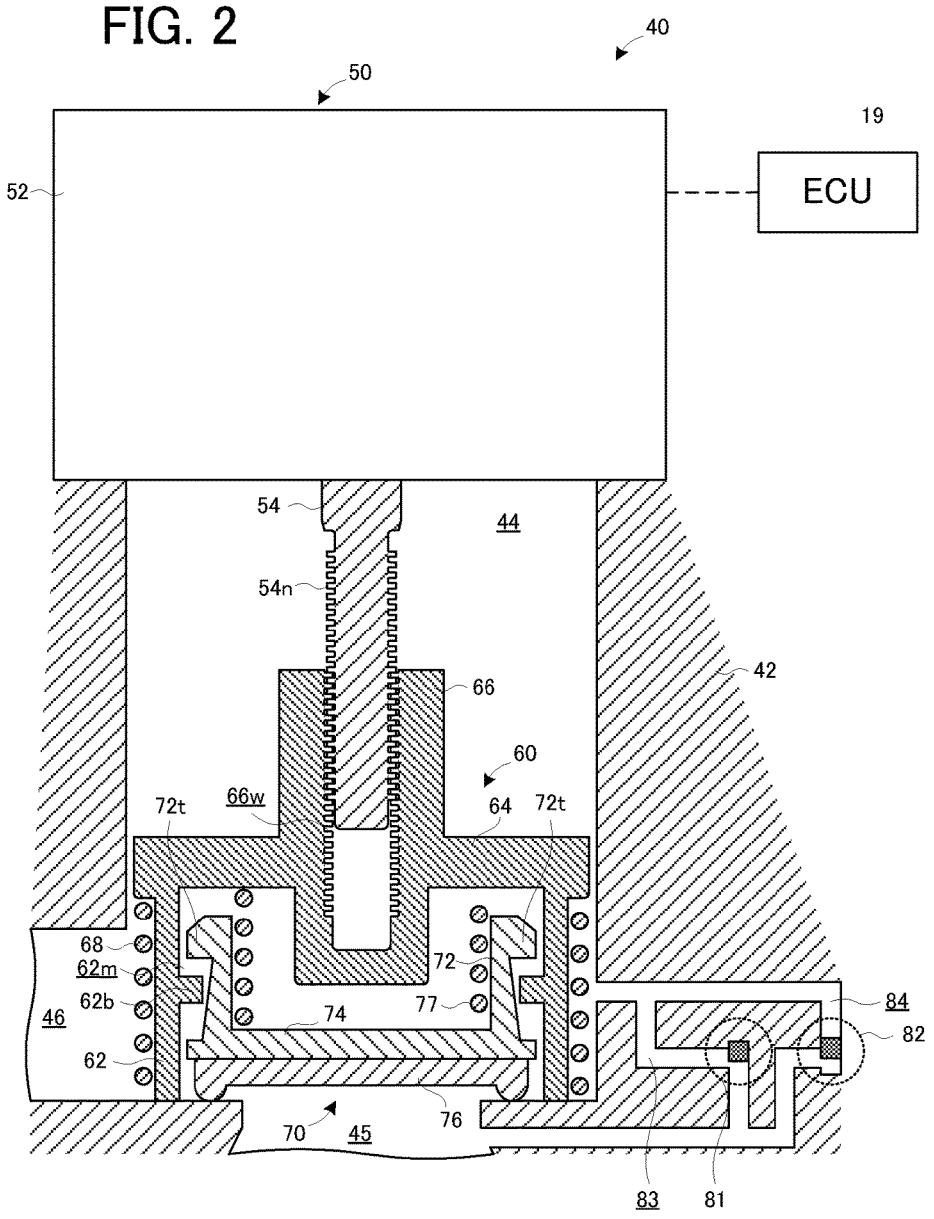
FIG. 2 is a longitudinal sectional view illustrating one state of a blocking valve according to the embodiment.

A configuration of the blocking valve 40 will be explained with reference to FIG. 2. FIG. 2 is a longitudinal sectional view illustrating one state of the blocking valve according to the embodiment.

In FIG. 2, the blocking valve 40 is provided with the valve casing 42, a stepping motor 50, a valve guide 60, and the valve body 70. The blocking valve 40 is further provided with a positive pressure relief valve 81 and a negative pressure relief valve 82.

The valve casing 42 is provided with a valve chamber 44, an inlet passage 45, and an outlet passage 46. The valve chamber 44, the inlet passage 45, and the outlet passage 46 constitute a fluid passage, which is one example of the "first flow passage" according to embodiments of the present invention.

The stepping motor 50 is mounted on an upper part of the valve casing 42. The stepping motor 50 has: a motor body 52; and an output shaft 54, which protrudes from a lower surface of the motor body 52 and which is configured to rotate in forward and reverse directions. The output shaft 54 is concentrically disposed in the valve chamber 44 of the valve casing 42, and a male screw 54*n* is formed on an outer peripheral surface of the output shaft 54.

The valve guide 60 is provided with a cylindrical wall 62 and an upper wall 64 configured to close an upper end opening of the cylindrical wall 62, and is formed in a topped cylindrical shape. A cylindrical shaft 66 is concentrically formed in a central part of the upper wall 64. A female screw 66*w* is formed on an inner peripheral surface of the cylindrical shaft 66. The valve guide 60 is movably disposed in an axial direction (or vertical direction), while rotation around the axial direction is stopped by a not-illustrated detent or rotation stopper, with respect to the valve casing 42.

The male screw 54*n* of the output shaft 54 of the stepping motor 50 is screwed into the female screw 66*w* of the cylindrical shaft 66 of the valve guide 60. This makes it possible for the valve guide 60 to move up and down in the axial direction on the basis of the forward and reverse rotation of the output shaft 54 of the stepping motor 50. Around the valve guide 60, there is provided an auxiliary spring 68 configured to bias the valve guide 60 upward.

The valve body 70 is provided with a cylindrical wall 72 and a lower wall 74 configured to close a lower end opening of the cylindrical wall 72, and is formed in a bottomed cylindrical shape. On a lower surface of the lower wall 74, for example, there is disposed the seal member 76 made of a disk-shaped rubber elastic material. The valve body 70 is concentrically disposed in the valve guide 60. The seal member 76 of the valve body 70 is disposed to abut on an upper surface of the valve seat of the valve casing 42 (near an end on the side of the valve chamber 44 in the inlet passage 45).

On an outer peripheral surface of the cylindrical wall 72 of the valve body 70, a plurality of coupling protrusions 72*t* are formed in a circumferential direction. The coupling protrusions 72*t* of the valve body 70 are fit in vertically-grooved coupling recesses 62*m* formed in an inner peripheral surface of the cylindrical wall 62 of the valve guide 60, to be relatively movable in the vertical direction by a fixed dimension. The valve guide 60 and the valve body 70 are configured to integrally move upward (i.e. in a valve opening direction) while bottom walls 62*b* of the coupling recesses 62*m* of the valve guide 60 abut on the coupling protrusions 72*t* of the valve body 70 from below. Between the upper wall 64 of the valve guide 60 and the lower wall 74 of the valve body 70, there is concentrically provided a valve spring 77 configured to bias the valve body 70 always downward (i.e. in a valve closing direction) with respect to the valve guide 60.

The positive pressure relief valve 81 is disposed in a flow passage 83 connecting the inlet passage 45 and the valve chamber 44. When the tank pressure of the fuel tank 15 is greater than or equal to a second predetermined pressure, such as e.g. 15 kPa, the positive pressure relief valve 81 is opened due to a pressure difference between the tank pressure and system pressure on the side of the canister 22 of the blocking valve 40 (typically, the atmospheric pressure). The "positive pressure relief valve 81" and the "second predetermined pressure" are respectively one example of the "relief valve" and the "predetermined pressure" according to embodiments of the present invention. The second predetermined pressure is greater than the aforementioned first predetermined pressure. The "inlet passage 45", the "flow passage 83", the "valve chamber 44", and the "outlet passage 46" constitute one example of the "second flow passage" according to embodiments of the present invention.

When the positive pressure relief valve 81 is opened, a gas on the side of the fuel tank 15 of the blocking valve 40 flows in the side of the canister 22 of the blocking valve 40 through the inlet passage 45, the flow passage 83, the valve chamber 44 (which is specifically, for example, a gap between the valve guide 60 and the valve casing 42), and the outlet passage 46, regardless of whether or not the seal member 76 of the valve body 70 is in contact with the valve seat of the valve casing 42 (in other words, regardless of a stroke amount of the valve guide 60).

The negative pressure relief valve 82 is disposed in a flow passage 84 connecting the valve chamber 44 and the inlet passage 45. When the tank pressure of the fuel tank 15 is less than or equal to a third predetermined pressure, which is less than the atmospheric pressure, the negative pressure relief valve 82 is opened due to the pressure difference between the tank pressure and the system pressure.

When the negative relief valve 82 is opened, a gas on the side of the canister 22 of the blocking valve 40 flows in the side of the fuel tank 15 of the blocking valve 40 through the outlet passage 46, the valve chamber 44, the flow passage 83, and the inlet passage 45, regardless of whether or not the seal member 76 of the valve body 70 is in contact with the valve seat of the valve casing 42 (in other words, regardless of the stroke amount of the valve guide 60).

(Operation of Blocking Valve)

Next, operation of the blocking valve 40 as configured above will be explained. The blocking valve 40 is configured to rotate the stepping motor 50 with a predetermined step number (i.e. a predetermined number of steps) in the valve opening direction or the valve closing direction on the basis of the signals from the ECU 19. As a result, due to screwing action of the male screw 54*n* of the output shaft 54 of the stepping motor 50 and the female screw 66*w* of the cylindrical shaft 66 of the valve guide 60, the valve guide 60 may move by a predetermined stroke amount in the vertical direction.

In an initial state of the blocking valve 40, the valve guide 60 is held at a lower limit position, and a lower end face of the cylindrical wall 62 abuts on the upper surface of the valve seat of the valve casing 42. In this state, the coupling protrusions 72*t* of the valve body 70 are located above the bottom walls 62*b* of the coupling recesses 62*m* of the valve guide 60 (refer to FIG. 2), and the seal member 76 of the valve body 70 is pressed to the upper surface of the valve seat of the valve casing 42 by spring force of the valve spring 77.

When the stepping motor 50 is rotated in the valve opening direction from the initial state of the valve guide 60, the valve guide 60 moves upward due to the screwing action of the male screw 54*n* and the female screw 66*w*, and the bottom walls 62*b* of the coupling recesses 62*m* of the valve guide 60 abut on the coupling protrusions 72*t* of the valve body 70 from below. Then, when the stepping motor 50 is further rotated in the valve opening direction and the valve guide 60 further moves upward, the valve body 70 moves upward with the valve guide 60, and the seal member 76 of the valve body 70 leaves the valve seat of the valve casing 42. As a result, the fluid passage (i.e. the valve chamber 44, the inlet passage 45, and the outlet passage 46) is communicated. The "valve guide 60" and the "valve body 70" according to the embodiment are one example of the "valve" according to embodiments of the present invention.

(Learning of Valve Opening Position of Blocking Valve)

A rotation amount (or rotation angle) of the stepping motor 50 configured to adjust the stroke amount of the valve guide 60 is controlled in a step unit. A step number of the stepping motor 50 corresponding to the stroke amount of the valve guide 60 at which the seal member 76 of the valve body 70 leaves the valve seat of the valve casing 42 is referred to as a "valve opening position". The stroke amount of the valve guide 60 at which the seal member 76 leaves the valve seat varies depending on the blocking valve 40 due to e.g. position tolerance of the coupling protrusions 72*t* formed on the valve body 70, position tolerance of the bottom walls 62*b* formed on the coupling recesses 62*m* of the valve guide 60, or the like. A valve opening position learning process of learning the valve opening position is thus performed on the evaporated fuel processing apparatus 20.

The valve opening position learning process is a process of detecting the valve opening position on the basis of a change in the tank pressure detected by the tank pressure sensor 15*s*, while gradually increasing the stroke amount of the valve guide 60 in the valve opening direction from a state in which the seal member 76 of the valve body 70 is in contact with the valve seat of the valve casing 42 (and in which, at this time, the lower end face of the cylindrical wall 62 of the valve guide 60 may not abut on the valve seat) when the tank pressure of the fuel tank 15 is positive. Various existing aspects can be applied to the valve opening position learning process An explanation of the details of the process will be thus omitted.

By the way, the positive pressure relief valve 81 is opened due to the pressure difference between the tank pressure and the system pressure. In other words, it is not possible to intentionally switch between the opening and the closing of the positive pressure relief valve 81. In the valve opening position learning process, the valve opening position is detected on the basis of the change in the tank pressure. Thus, if the positive pressure relief valve 81 is opened during the valve opening position learning process, the valve opening position is likely erroneously learned.

Therefore, in the embodiment, a pressure relief operation of depressurizing the tank pressure of the fuel tank 15 described below is performed.

(Pressure Relief Operation)

The pressure relief operation according to the embodiment will be explained with reference to FIG. 3 and FIG. 4.

Figure 3:
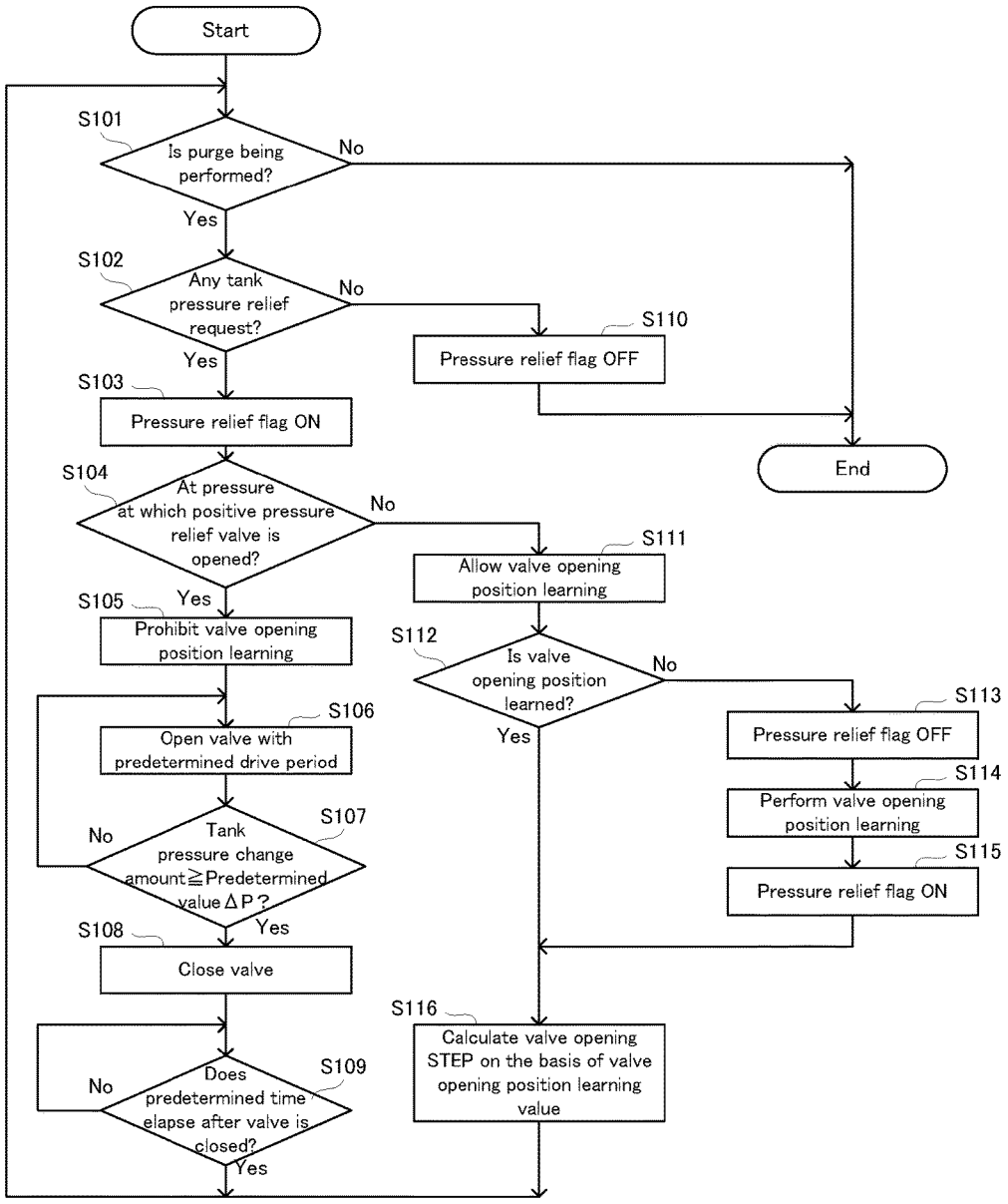
FIG. 3 is a flowchart illustrating an pressure relief operation according to the embodiment.

In FIG. 3, the ECU 19, which is a part of the evaporated fuel processing apparatus 20, determines whether or not purge is being performed (step S101). In the determination, if it is determined that the purge is not being performed (the step S101: No), the process is ended, and the ECU 19 then performs the step S101 again after a lapse of a first predetermined time (e.g. several milliseconds to several seconds). The "ECU 19" according to the embodiment is one example of the "controller" according to embodiments of the present invention.

On the other hand, in the determination in the step S101, if it is determined that the purge is being performed (the step S101: Yes), the ECU 19 determines whether or not there is a request for pressure relief of the fuel tank 15 (step S102). The ECU 19 is configured to determine that there is a pressure relief request when the tank pressure is greater than or equal to a predetermined value A as the aforementioned first predetermined pressure. The ECU 19 is configured to determine that there is no pressure relief request when the tank pressure is less than the predetermined value A.

In the determination in the step S102, if it is determined that there is no pressure relief request (the step S102: No), the ECU 19 turns "OFF" a pressure relief flag (or when the pressure relief flag is "OFF", the ECU 19 maintains the OFF state) (step S110), and ends the process. The ECU 19 then performs the step S101 again after a lapse of the first predetermined time.

On the other hand, in the determination in the step S102, if it is determined that there is a pressure relief request (the step S102: Yes), the ECU 19 turns "ON" the pressure relief flag and determines whether or not the tank pressure corresponds to a pressure at which the positive pressure relief valve 81 is opened (step S104). The ECU 19 is configured to determine that the tank pressure corresponds to the pressure at which the positive pressure relief valve 81 is opened when the tank pressure is greater than or equal to a predetermined value B as the second predetermined pressure. The ECU 19 is configured to determine that the tank pressure does not correspond to the pressure at which the positive pressure relief valve 81 is opened when the tank pressure is less than the predetermined value B. The predetermined value B is greater than the predetermined value A.

In the determination in the step S104, if it is determined that the tank pressure corresponds to the pressure at which the positive pressure relief valve 81 is opened (the step S104: Yes), the ECU 10 prohibits the valve opening position learning process (step S105). The ECU 19 then rotates the stepping motor 50 in the valve opening direction with a predetermined drive period (e.g. one step, second steps, four steps, etc.) and moves the valve guide 60 upward, thereby communicating the inlet passage 45 with the valve chamber 44 (step S106). Communicating the inlet passage 45 with the valve chamber 44 will be hereinafter referred to as "opening the blocking valve 40", as occasion demands.

The ECU 19 then determines whether or not a change amount of the tank pressure is greater than or equal to a predetermined value ΔP (step S107). In this determination, if it is determined that the change amount of the tank pressure is less than the predetermined value ΔP (the step S107: No), the ECU 19 continues the step S106. When the step number of the stepping motor 50 reaches the predetermined step number, the ECU 10 maintains the step number. The "predetermined step number" is set as a step number with which the seal member 76 of the valve body 70 surely leaves the valve seat of the valve casing 42 even when the valve opening position learning process is not ended (i.e. even when the valve opening position is not learned).

On the other hand, in the determination in the step S107, if it is determined that the change amount of the tank pressure is greater than or equal to the predetermined value ΔP (the step S107: Yes), the ECU 19 rotates the stepping motor 50 in the valve closing direction and moves the valve guide 60 downward, thereby shutting off the inlet passage 45 from the valve chamber 44 (step S108). Shutting off the inlet passage 45 from the valve chamber 44 will be hereinafter referred to as "closing the blocking valve 40", as occasion demands.

After the blocking valve 40 is closed, the ECU 19 determines whether or not a second predetermined time elapses (step S109). The "second predetermined time" may be set as a time required for all (or almost all) of the evaporated fuel, which flows in the canister 22 because the blocking valve 40 is opened, to flow in the intake passage 17 of the engine 14 through the purge valve 26*v*.

In the determination in the step S109, if it is determined that the second predetermined time does not elapse after the blocking valve 40 is closed (the step S109: No), the ECU 19 performs the step S109 again.

On the other hand, in the determination in the step S109, if it is determined that the second predetermined time elapses after the blocking valve 40 is closed (the step S109: Yes), the ECU 19 performs the step S101.

In the determination in the step S104, if it is determined that the tank pressure does not correspond to the pressure at which the positive pressure relief valve 81 is opened (the step S104: No), the ECU 19 allows the valve opening position learning process (step S111), and determines whether or not the valve opening position is learned on the basis of presence of a history of the valve opening position, which is learned by the valve opening position learning process, after current ignition-on (step S112). In this determination, if it is determined that the valve opening position is learned (the step S112: Yes), the ECU 19 performs a step S116 described later.

On the other hand, in the determination in the step S112, if it is determined that the valve opening position is not learned (the step S112: Yes), the ECU 19 temporarily turns "OFF" the pressure relief flag (step S113), and performs the valve opening position process (step S114). In the step S114, the purge valve 26*v* and the switching valve 28*v* are closed by the ECU 19 before the valve opening position process is started.

After the valve opening position process is ended, the ECU 19 returns the pressure relief flag to "ON" (step S115). The ECU 19 then determines a target step number of the stepping motor 50 (i.e. adjusts the stroke amount of the valve guide 60), and controls a flow rate of a gas flowing the vapor passage 24 (step S116). As a result, the tank pressure is depressurized.

Next, one specific example of a change in the tank pressure and a change in the step number of the stepping motor 50 by the pressure relief operation will be explained with reference to FIG. 4. It is assumed in an example illustrated in FIG. 4 that the valve opening position is not learned before a time point t1 after the current ignition-on.

Figure 4:
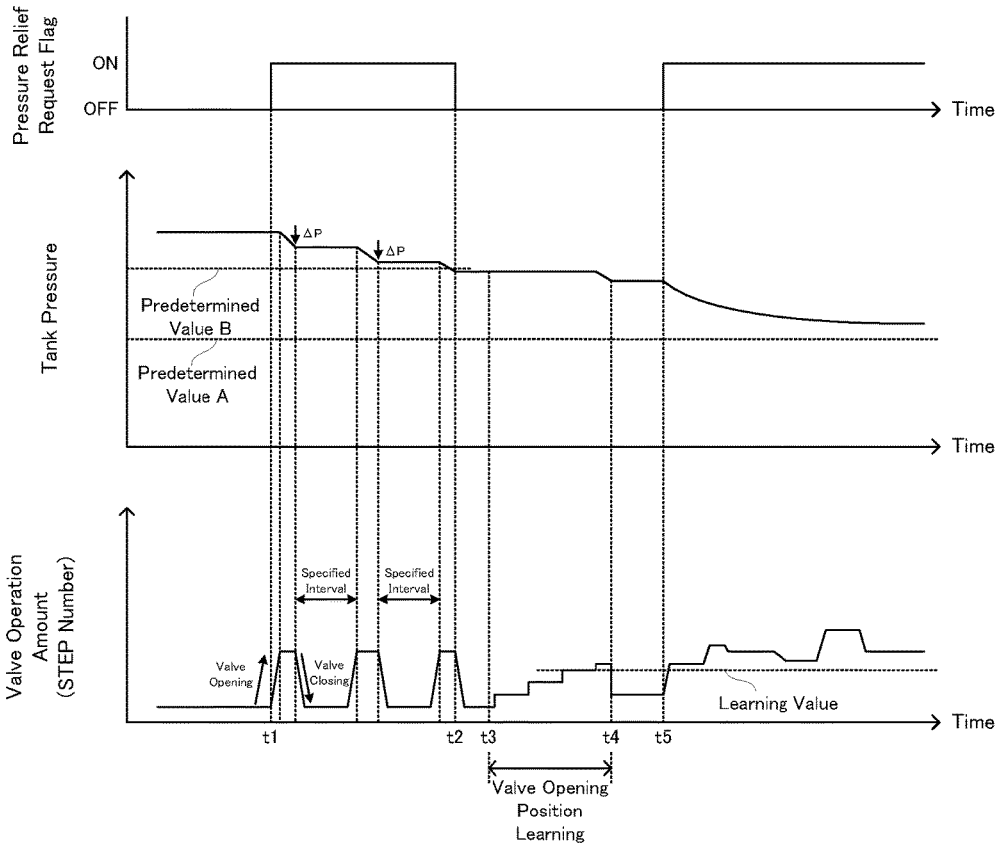
FIG. 4 is a conceptual diagram illustrating a concept of time variation of tank pressure and a concept of time variation of a step number of a stepping motor, in the pressure relief operation according to the embodiment.

It is assumed that the pressure relief flag is turned "ON" at the time point t1 in FIG. 4. At this time, the tank pressure is greater than or equal to the predetermined value B, and the valve opening position learning process is thus prohibited (the step S105), and the step S106 and the step S109 are performed. As a result, in order to open the blocking valve 40, the step number of the stepping motor 50 is increased to the aforementioned predetermined step. After the tank pressure is reduced by the predetermined value ΔP, the blocking valve 40 is closed (refer to the time point t1 to a time point t2 in FIG. 4).

At the time point t2 in FIG. 4 at which the tank pressure becomes less than the predetermined value B, the valve opening position learning process is allowed (the step S111), and the pressure relief flag is temporarily turned "OFF" (the step S113). Then, at a time point t3, the valve opening learning process is started. The step number of the stepping motor 50 is gradually increased (i.e. the stepping motor 50 is gradually rotated in the valve opening direction). When a reduction in the tank pressure is detected, the valve opening position is learned. The valve opening learning process is ended at a time point t4.

Then, at a time point t5 at which the pressure relief flag is returned to "ON" (the step S115), the ECU 19 controls the stepping motor 50 and opens the blocking valve 40 on the basis of the learned valve opening position, and depressurizes the tank pressure (the step S116).

(Technical Effect)

On the evaporated fuel processing apparatus 20, when the tank pressure of the fuel tank 15 is greater than or equal to the second predetermined pressure (or the predetermined value B) at which the positive pressure relief valve 81 is opened, the valve opening position learning process is prohibited, and the stepping motor 50 is controlled to open the blocking valve 40 and to depressurize the tank pressure. On the other hand, when the tank pressure of the fuel tank 15 is less than the second predetermined pressure (or the predetermined value B), the valve opening position learning process is not prohibited. In other words, on the evaporated fuel processing apparatus 20, if there is a possibility that the tank pressure of the fuel tank 15 varies because the positive pressure relief valve 81 is opened, the valve opening position learning process is prohibited. Therefore, according to the evaporated fuel processing apparatus 20, it is possible to prevent erroneous leaning of the valve opening position.

On the evaporated fuel processing apparatus 20, when the tank pressure is greater than or equal to the second predetermined pressure, the blocking valve 40 is opened, and then, the blocking valve 40 is closed on condition that the change amount of the tank pressure is greater than or equal to the predetermined value ΔP. It is thus possible to prevent that excessive evaporated fuel flows in the canister 22 because the blocking valve 40 for depressurizing the tank pressure is opened.

The invention may be embodied in other specific forms without departing from the spirit or essential characteristics thereof. The present embodiments and examples are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An evaporated fuel processing apparatus including: a canister containing adsorbent for adsorbing evaporated fuel generated in a fuel tank; a vapor passage connecting the canister and the fuel tank; and a blocking valve disposed in the vapor passage, wherein the blocking valve has:

a first flow passage connecting a side of the fuel tank of the blocking valve and a side of the canister of the blocking valve;

a second flow passage connecting the side of the fuel tank of the blocking valve and the side of the canister of the blocking valve but differing from the first flow passage;

a valve disposed in the first flow passage, allowing shutoff in the first flow passage if a stroke amount is less than a predetermined amount, and allowing communication in the first flow passage if the stroke amount is greater than or equal to the predetermined amount;

a stepping motor configured to adjust the stroke amount; and a relief valve disposed in the second flow passage and being opened regardless of the stroke amount when a tank pressure of the fuel tank is greater than or equal to a predetermined pressure to allow communication in the second flow passage, and said evaporated fuel processing apparatus comprises a controller configured (i) to control the stepping motor to allow the communication in the first flow passage by moving the valve in a valve opening direction while prohibiting a valve opening position learning process in which a valve opening position of the valve is learned on the basis of a change in the tank pressure when the tank pressure is greater than or equal to the predetermined pressure and (ii) to allow the valve opening position learning process when the tank pressure is less than the predetermined pressure, wherein said controller is configured to control the stepping motor to allow the communication in the first flow passage by moving the valve in the valve opening direction while prohibiting the valve opening position learning process when the tank pressure is greater than or equal to the predetermined pressure, and then to control the stepping motor to allow the shutoff in the first flow passage by moving the valve in a valve closing direction on condition that the tank pressure is reduced by a predetermined change amount.

* * * * *